United States Patent [19]

Westin

[11] Patent Number: 4,585,619

[45] Date of Patent: Apr. 29, 1986

[54] METHOD OF PRODUCING HIGH SPEED STEEL PRODUCTS METALLURGICALLY

[75] Inventor: Leif Westin, Söderfors, Sweden

[73] Assignee: Kloster Speedsteel Aktiebolag, Soderfors, Sweden

[21] Appl. No.: 731,045

[22] Filed: May 6, 1985

[30] Foreign Application Priority Data

May 22, 1984 [SE] Sweden ..... 8402752

[51] Int. Cl.[4] ..... B22F 3/24

[52] U.S. Cl. ..... 419/28; 419/29; 419/31; 419/33; 419/38; 419/39; 419/49; 419/53; 419/54; 419/55

[58] Field of Search ..... 419/28, 31, 29, 33, 419/38, 39, 42, 44, 49, 53, 54, 55, 57

[56] References Cited

U.S. PATENT DOCUMENTS

| | | | |
|---|---|---|---|
| 4,094,709 | 6/1978 | Rozmus | 419/29 |
| 4,142,888 | 3/1979 | Rozmus | 419/48 X |
| 4,209,326 | 6/1980 | Klein et al. | 419/32 |
| 4,212,669 | 7/1980 | Veeck et al. | 419/49 X |
| 4,233,720 | 11/1980 | Rozmus | 419/48 |

*Primary Examiner*—Stephen J. Lechert, Jr.
*Attorney, Agent, or Firm*—Murray and Whisenhunt

[57] ABSTRACT

The invention relates to a powder metallurgical method for producing high speed steel products, the shape of which is close to the desired final shape of the product, i.e. according to the so called near net shape technique. The method comprises the following steps:

(a) a starting powder consisting of high speed steel is soft annealed in a first annealing step in a non-oxidizing environment, (b) the soft annealed powder is fragmented mechanically, (c) the fragmented powder is annealed in the austenitic region of the steel in a second annealing step in a non-oxidizing environment thereby to improve the compactability of the fragmented powder by reducing its hardness and by forming aggregates of fragmented particles, compactability signifying the ability of the powder to form a manageable powder body, a so called green body, (d) the powder is compacted mechanically, after being annealed and having formed aggregates in said second annealing step, in a die to form a green body of the desired product shape, (e) the green body is sintered in a non-oxidizing environment until communicating porosity has been eliminated, and (f) the sintered body is subjected to hot isostatic compaction to full density.

13 Claims, 4 Drawing Figures

TEMPERATURE GRAPHS FOR SINTERING AND SOFT ANNEALING

DENSITY OF THE SINTERED BODIES AS A FUNCTION OF THE SINTERING TEMPERATURE AND PRESSURE

METHOD OF PRODUCING HIGH SPEED STEEL PRODUCTS METALLURGICALLY

TECHNICAL SCOPE

The invention relates to a metallurgical method of producing high speed steel products, the shape of which is close to the desired final shape of the product, in other words production according to the so called near-net-shape technique. More specifically the invention relates to a near-net-shape technique comprising hot isostatic compacting to full density of a sintered green body.

PRIOR ART

It is known that objects of near net shape may be produced by a powder metallurgy technique comprising hot isostatic pressing to full density. The prime object of this technique is to combine the qualitative advantage to be obtained by starting from a metal powder (homogeneity, no segregations) with the advantages of high material yield and lower machining costs (less machining required as compared to conventional technique).

A condition for hot isostatic compacting is that the pressure medium cannot communicate with the interior of the sintered powder body. Suggestions have been made, therefore, to put the powder inside a casing, impenetrable to the pressure medium, the shape of which approximates that of the desired product. Examples of this technique are described in SE 414 920, U.S. Pat. Nos. 3,992,200, and 4 065 303. The production of such casings, such as "made-to-measure" steel sheet containers, glass vessels etc, involves extra expenses, however.

Another technique is also known, comprising the following steps: the production of metal powder by water atomisation of a metal melt, drying and annealing the powder, compacting the powder to form a green body, and vacuum sintering the green body to form the finished product. To the established techniques belong the so called Fulden-process as described in Metal Powder Report, 38 (April 1983): P.M. Methods for the Production of High Speed Steels; the Powdrex powder process described in Precision Tool Maker, March 1983; Current Development in P.M. High Speed Steel; and the so called HTM process, also described in Metal Powder Report, 38 (April 1983): Full Density NNS P.M. Part via the HTM Process. A similar process (Edgar Allen) is described in the Proceedings of the 10th Plansee Seminar 1981, Vol. 2: Cutting Properties of Directly Sintered HSS Tools. Any successful applications of products produced according to any of these methods are in areas where especially their resistance to abrasion is an important property. An example of such an application is piston rings for diesel pumps. For most other applications, especially for the cutting of steel and metal, the ductility of sintered high speed steel is not high enough for use under professional circumstances, however.

If a dense or almost dense product (with a relative density greater than 99.9%) without structure coursening is desired, sintering must be carried out at a relatively low temperature and the grain size of the starting powder must be small. Further, the amount of carbon must be well balanced in relation to the amount of alloying elements present, from the point of view of sintering. To achieve full density the products must also be hot compacted isostatically. A method which complies with these requirements is described in for example DE-OS 31 38 669.

DISCLOSURE OF THE INVENTION

The object of this invention is to provide an improvement of the technique defined in the introductory statement above. The starting material may be water atomised powder, which is compressible but contains much oxygen, 300–2000 ppm, and therefore must be reduced, or gas atomised spherical powder with a low oxygen content, 30–200 ppm, which cannot be compressed, however, without severe mechanical fragmentation of the spherical particles. In both cases the grain size of the powders is much too large to allow sintering without structure coarsening, which necessitates fragmenting the particles mechanically. The invention constitutes an improvement of the method described in said DE-OS 31 38 669, and is characterised by the following steps:

(a) soft annealing a starting powder of high speed steel in a first annealing step in a non-oxidising environment, (b) fragmenting the soft annealed powder mechanically, (c) annealing the fragmented powder in the austenitic region of the steel in a second annealing step in a non-oxidising environment in order to improve the compactability of the fragmented powder by reducing its handness and by forming aggregates of fragmented particles, compactability signifying the ability of the powder to form a manageable powder body, a so called green body, (d) mixing the powder, which has been annealed and aggregated in said second annealing step, with graphite of high purity, if necessary, to adjust the carbon to oxygen ratio, and compacting it mechanically in a pressing tool to form a green body in the shape of the desired product, (e) sintering the green body in a non-oxidising environment until any communicating pores have been eliminated, and (f) subjecting the sintered body to hot isostatic compaction to full density.

The soft annealing of the powder is preferably carried out in vacuum in the ferritic our austenitic region of the steel. The fragmentation is preferably carried out by wet milling in a milling liquid containing no more than 0.1% $H_2O$. The milling liquid consists of one or several organic solvents. Further, the milling is preferably carried out in a mill lined with high speed steel.

Experiments indicate that the fragmented powder should be annealed in at least two steps, viz. a first step at a temperature of 850°–950° C., and a second step at a temperature of between 75° and 250° C. below that of the first step. On the other hand, the annealing of the second step should be carried out for a period of time which is 2–20 times that of the first step. If necessary, the powder is ground after annealing and fragmentation, i.e. if it has sintered during the annealing to form larger agglomerates, before being compacted to a green body. This compacting is done in a die under a pressure which is preferably between 300 and 700 MPa, suitably 400–600 MPa. Before the compaction, a pressing additive may be added to the powder at a concentration of 0.1–0.5%. sintering the green body before the final hot isostatic compacting may be done at a temperature of between 1150° and 1250° C., depending on the chemical composition chosen. With the preferred compositions, sintering is preferably carried out at a temperature between 1180° and 1220° C.

Further characteristics and advantages of the invention will become apparent from the following description of experiments carried out and results obtained.

BRIEF DESCRIPTION OF DRAWINGS

In the following description of experiments and results reference will be made to the attached drawings, wherein.

DESCRIPTION OF EXPERIMENTS

Powders of two commercially available high speed steels, viz. ASP®23 and ASP®30 were used in the experiments. These steel qualities have the following nominal compositions.

TABLE 1

| Steel type | C | Si | Mn | Cr | Mo | W | V | Co |
|---|---|---|---|---|---|---|---|---|
| ASP ® 23 | 1,27 | 0,5 | 0,3 | 4,2 | 5,0 | 6,4 | 3,1 | |
| ASP ® 30 | 1,27 | 0,5 | 0,3 | 4,2 | 5,0 | 6,4 | 3,1 | 8,5 |

In order both to make the spherical powder compactible and to reduce its required sintering time, the powder was ground in a wet mill. The mills were lined with cemented carbide and the grinding bodies were also made of cemented carbide. Ethanol and dichloromethane were tested as milling liquids. Of these two, ethanol is preferable, since it is cheap and not very poisonous and provides for the same milling rate as chloromethane, which is more expensive and poisonous. It is important, however, that the ethanol initially should contain as little water as possible, preferably less than 0.1% water. the mill was filled by first entering powder and grinding bodies and thereafter milling liquid, so that a minimum of air remained under the lid. The lid was sealed against the mill by means of a rubber O-ring.

During the work with different milling liquides, a number of observations were made concerning oxidation. They prompted the conclusion that the milling liquid should be free of water, and preferably have a low water solubility, and that a hydrocarbon ought to be an ideal milling liquid.

Figure 1:
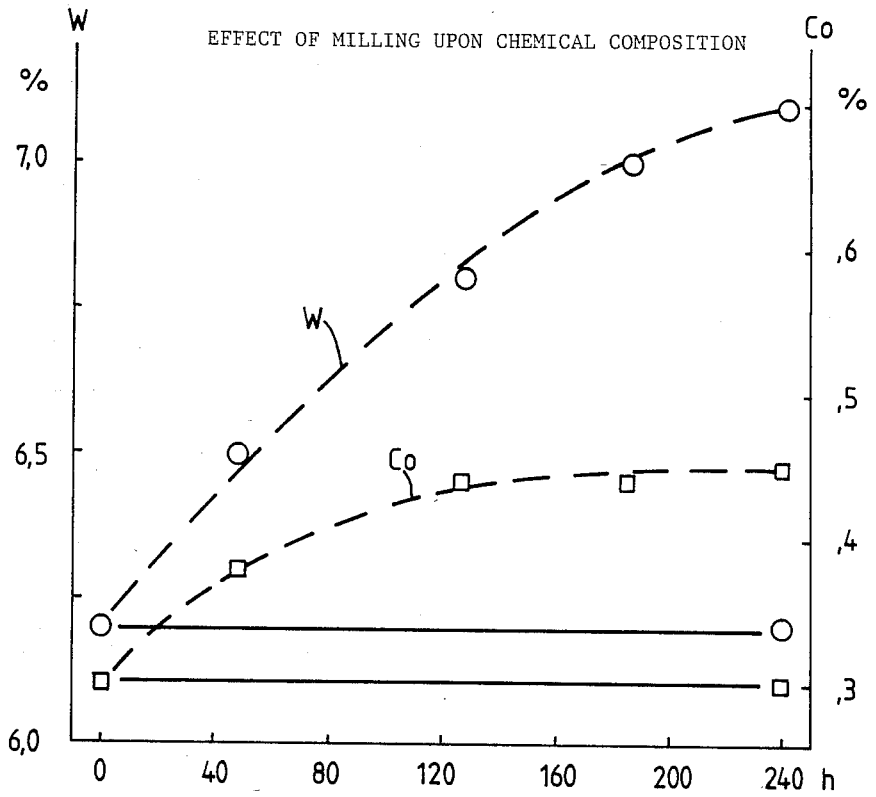
FIG. 1 illustrates graphically how the chemical composition of the powder changes during milling as a result of the absorbtion of alloying elements from the lining of the mill.

The untreated high speed steel powder wore heavily on the mill lining. since this lining, as well as the grinding bodies, were made of cemented carbide, this meant that the tungsten content of the high speed steel powder increased continously during milling, which is illustrated in FIG. 1. When ASP®23 was ground, an increase in the cobalt content was also apparent. The carbon content also increased.

In some cases the powder was annealed before milling. This is indicated in FIG. 1 by solid lines, the dashed lines representing powder which was not annealed. The milling liquid was ethanol. The extra annealing before milling was the following advantages: The powder became compactible, the wear on the mill was low or none, the crushing rate was increased and it became possible to use mills lined with high speed steel instead of cemented carbide.

The effect of the soft annealing is also apparent from the results of Table 2. It is assumed that the two types of steel are so similar that the difference does not influence the result.

TABLE 2

| Powder No. | Type of steel | Grinding time (h) | Annealing before grinding | Average particle size (μm) | Compact-tible |
|---|---|---|---|---|---|
| Cyclone | ASP ® 30 | 0 | — | 45.6 | No |
| 1 | ASP ® 30 | 192 | No | 14.4 | No |
| 2 | ASP ® 23 | 240 | No | ~15 | No |
| 3 | ASP ® 23 | 240 | Yes | 9.7 | Yes |
| 4 | ASP ® 30 | 148 | Yes | ~15 | Yes |

Figure 2:
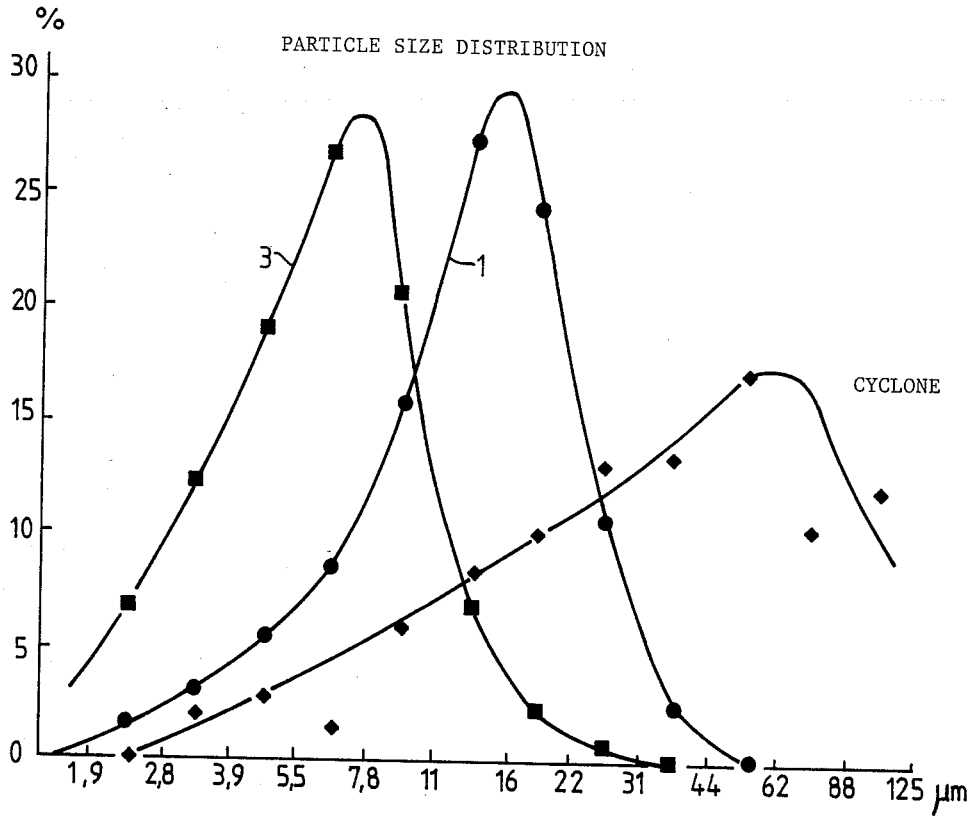
FIG. 2 illustrates graphically the particle size distribution of some powders, FIG. 3 displays temperature graphs for soft annealing and sintering.

In FIG. 2 the particle size distribution of the starting powder (so called cyclone powder, a small grain size rest product from gas atomisation of high speed steel) and of powders 1 and 3 are illustrated. The characteristics of the powders are also apparent from the following Table 3.

TABLE 3

| Powder Type | CS $m^2/cm^3$ | MV μm | PH 10% μm | PM 50% μm | PS 10% μm |
|---|---|---|---|---|---|
| Cyclone | .287 | 45.6 | >99.6 | >35.3 | >9.5 |
| 1 | .580 | 14.4 | >24.2 | >13.2 | >5.4 |
| 3 | .844 | 9.7 | >15.6 | >8.6 | >3.8 |

Figure 3:
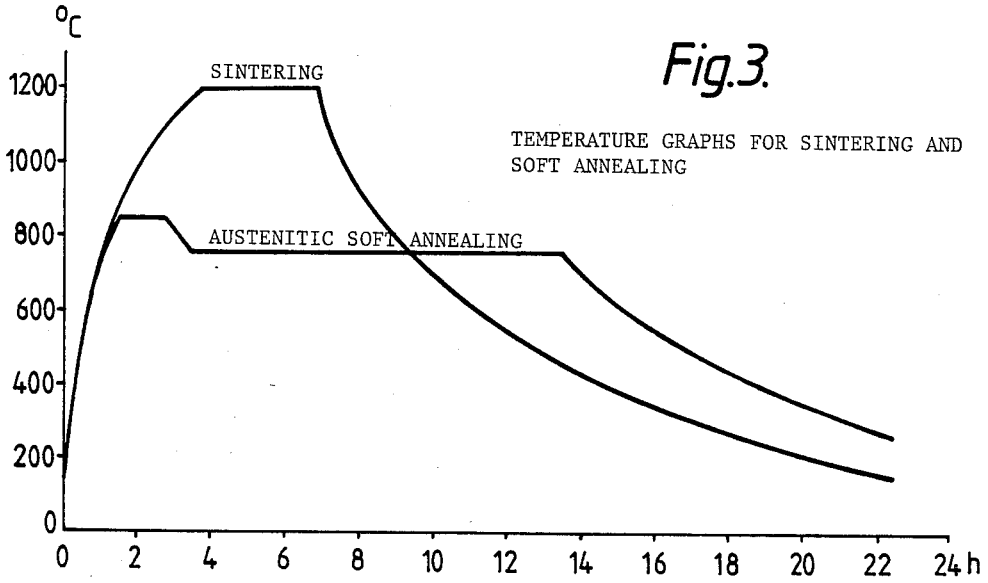

CS = estimated surface area
MV = mean particle diameter
PH = upper limit
PM = median value
PS = lower limit After milling the powder was soft annealed. All soft annealing i.e. including annealing before milling, was carried out in vacuum. The least hardness was chieved by austenitic, isothermal heat treatment: 850° C./1 h+750° C./10 h. The time-temperature graph for annealing and sintering is reproduced in FIG. 3. The purpose of annealing after milling is to improve compactability by reducing hardness and by producing aggregates of powder. The latter object could be realized by raising the austenitization temperature from 850° C. to 900° C. The formation of these aggregates is important from the compacting point of view, to make the powder flow in the desired manner during processing.

In these cases no graphite was added to the powder. The reason for this is the low oxygen content of the starting powder (appr. 200 ppm) and moderate increase of the oxygen content during milling. When water atomised powders or other types of powder with greater initial oxygen content is used, when the milling liquid is water, or when the mill is not tightly sealed, graphite should be added. The amount of graphite to be added in these cases is determined stoichiometrically in relation to the carbon and oxygen contents of the powder. High speed steel powder and graphite may be mixed by dry milling for about 30 minutes. From the ground and annealed powder pressed powder bodies were produced, partly in the form of short cylinders and partly in the form of larger elongated plates. When the cylinders were to be pressed, 0.3% pressing additive was added, such as Kamfer or Sterotex (trade names). The plates were pressed without pressing additives, however. During the sintering process following the pressing a transport of material takes place, which strives to reduce the total surface area of the powder, and consequently the porosity of the powder body. This can occur by diffusion along surfaces and grain boundaries, the driving force being surface tension. A low temperature gives a low sintering rate and considerable rest porosity. Much rest porosity may involve open porosity as well, which cannot be eliminated by hot isostatic compacting. A high sintering temperature, on the other hand, may cause the structure to become coarser as the carbides grow or grains coalesce. By choosing a fine grain size powder and by hot final pressing, a sintering temperature may be chosen fairly freely, however, within an interval of about 50° C., depending on desired structure and demands on the surface properties.

A better result as regards rest porosity and carbide structure may be obtained if the sintering time is increased and the temperature decreased. In the experiments reported here, the sintering temperatures have been within the 1180° to 1220° C. range. Single runs indicate, however, that at least the fine grain size powders may be hot pressed isostatically after sintering at about 1150° C., which provides for a fine grain cabide structure after hardening.

Figure 4:
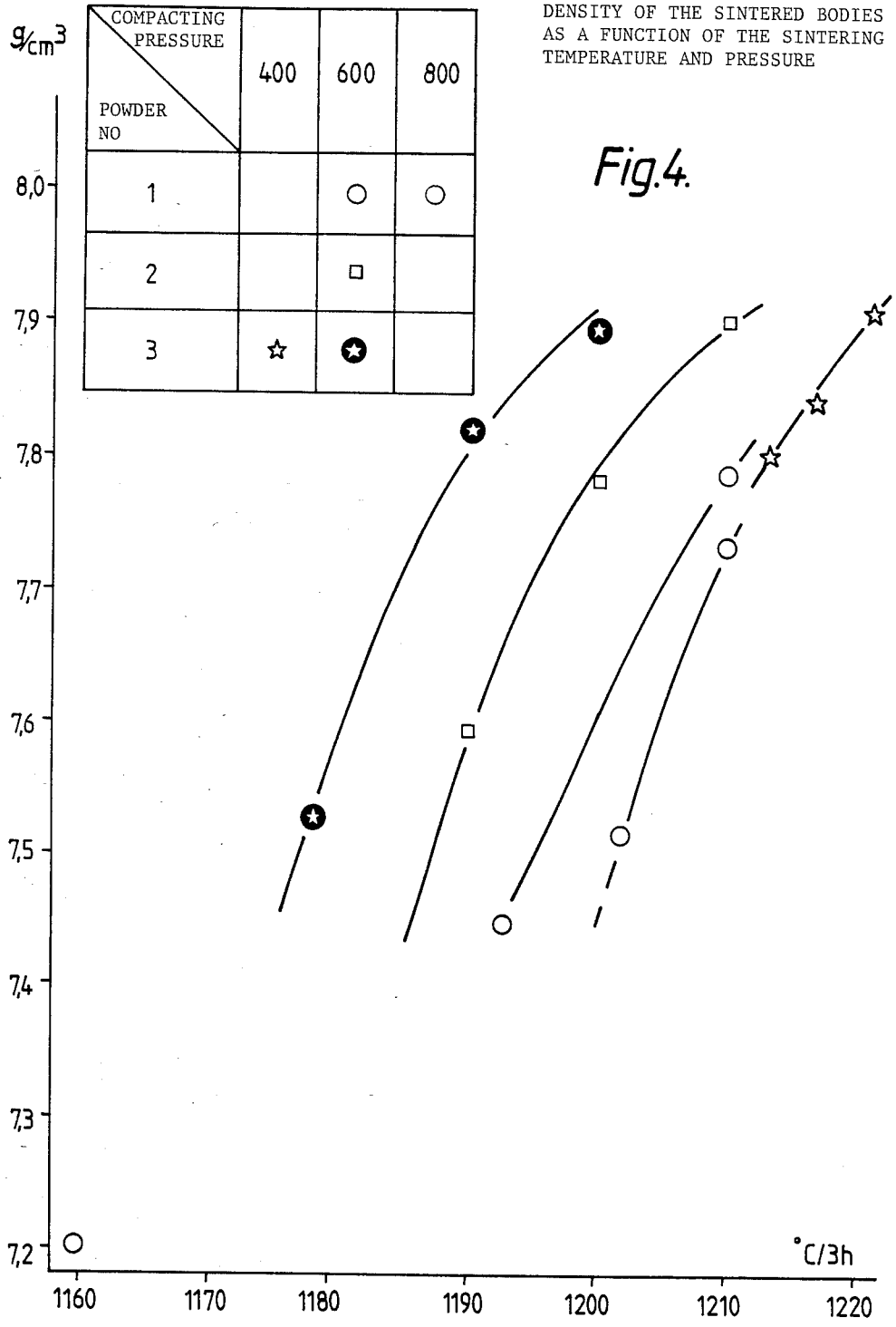
FIG. 4 illustrates graphically the density of the sintered bodies as a function of the sintering temperature and pressure.

An increased compacting pressure gives shorter diffusion distances and less rest porosity. Therefore, a high compacting pressure is advantageous from the sintering point of view. A high compacting pressure also means greater wear on the pressing die, however. A compacting pressure of 600 MPa may be regarded as an acceptable compromise. In FIG. 4 is illustrated how the density of the sintered body varies with sintering temperature and compacting pressure.

The density of the sintered body depends on the type of powder (chemical composition and form), the sintering temperature and time, the density of the green body (pressure, lubricant, height|width ratio), and the sintering atmosphere (gas pressure, gas composition).

FIG. 4 shows that powder No 4 sinters to a given density in the range of 7.5–7.9 g/cm$^3$ faster than powder No 1. This is interpreted as a result of the difference in carbon content, 1.30 and 1.13%, respectively. This carbon content difference is present after milling as well, 1.7 and 1.5%, respectively.

Finally the sintered bodies were hot compacted isostatically, at 1150° C./1 h under argon at 100 MPa. The density of the hot isostatically compacted material showed very little co-variation with the sintering temperature within the range of 1180°–1220° C. This indicates that any existing pores were closed. The results are presented in Table 4, where succesful hot compacting has been indicated by a * in the table.

TABLE 4

| Test No | Powder type | Lubricant K = Kamfer S = Sterotex | Compacting pressure MPa | Sint. temper. °C. | Density g/cm$^3$ Green body | Density g/cm$^3$ Sint. body | Hot comp. body | Form[1] C = Cylinder P = Plate |
|---|---|---|---|---|---|---|---|---|
| 1 | 1 | S | 400 | 1160 | | 6.97 | 7.14 | C |
| 2 | " | " | 600 | " | 5.70 | 7.20 | *8.21 | " |
| 3 | " | K | 400 | 1193 | | 7.19 | 7.51 | " |
| 4 | " | " | 600 | " | 5.70 | 7.45 | *8.18 | " |
| 5 | " | S | 800 | 1200 | | 7.92 | — | " |
| 6 | " | " | 400 | 1210 | | 7.58 | *8.18 | " |
| 7 | " | " | 600 | " | 5.70 | 7.78 | *8.21 | " |
| 8 | " | " | 400 | 1220 | | 7.78 | *8.15 | " |
| 9 | " | " | 600 | " | | 8.03 | — | " |
| 10 | " | " | 800 | " | | 8.04 | — | " |
| 11 | " | K | " | " | 6.04 | 7.67 | *8.19 | " |
| 12 | " | " | " | " | 6.01 | 7.58 | *8.22 | " |
| 13 | 3 | K | 600 | 1178 | 5.67 | 6.92 | 7.25 | " |
| 14 | " | " | " | 1190 | 5.65 | 7.59 | *7.58 | " |
| 15 | " | — | 400 | 1193 | | 7.74 | — | P |
| 16 | " | K | 600 | 1200 | | 7.78 | *7.85 | C |
| 17 | " | — | 400 | 1201 | | 7.81 | — | P |
| 18 | " | — | " | " | | 7.78 | — | " |
| 19 | " | — | " | " | | 7.81 | — | " |
| 20 | " | — | " | " | | 7.89 | — | " |
| 21 | " | K | 600 | 1210 | 5.61 | 7.92 | *7.93 | C |
| 22 | 4 | K | 600 | 1178 | 5.60 | 7.66 | *7.91 | C |
| 23 | " | " | " | 1190 | 5.76 | 7.73 | *7.84 | " |
| 24 | " | " | " | 1200 | 5.83 | 7.90 | *7.96 | " |
| 25 | " | — | 400 | 1207 | 4.87 | 7.89 | — | P |
| 26 | " | — | " | 1213 | 4.87 | 7.89 | — | " |
| 27 | " | K | 600 | 1210 | 5.49 | 7.82 | *7.84 | C |
| 28 | " | — | " | 1217 | 4.94 | 7.84 | — | P |
| 29 | " | K | 800 | 1220 | | 7.62 | *8.21 | C |
| 30 | " | — | 400 | 1222 | 4.87 | 7.91 | — | P |

[1]Cylinder = diameter 30 mm, height 4 mm
Plate = length 120 mm, width 20 mm, height 6–8 mm

I claim:

1. Method for the powder metallurgical production of high speed products comprising (a) soft annealing a starting high-speed steel powder in a first annealing step in a non-oxidizing environment (b) mechanically fragmenting the soft annealed powder (c) annealing the fragmented powder in a second annealing step at the austenitic temperature region of the steel in a non-oxidizing environment to improve the compactability of the fragmented powder by reducing its hardness and by forming aggregates of fragmented particles (d) mechanically compacting the second annealed fragmented powder in a die to form a green body of the desired product shape (e) sintering the green body in a non-oxidizing environment until communicating porosity has been eliminated and (f) Subjecting the sintered body to hot isostatic compaction to full density.

2. Method according according to claim 1, wherein the annealing of the starting powder is carried out in vacuum.

3. Method according to claim 1, wherein the soft annealed powder is fragmented by wet milling the powder using a milling liquid containing no more than 0.1% $H_2O$.

4. Method according to claim 3, wherein the milling liquid contains at least one organic solvent.

5. Method according to claim 3, wherein the milling is conducted in a mill which is lined with high speed steel.

6. Method according to claim 1, wherein the annealing of the fragmented powder is conducted in at least two steps, wherein a first step is at a temperature of between 850° and 950° C., and the second step is at a temperature which is 75°-250° C. lower than the temperature of the first step but for a length of time which is 2-20 times that of the first step.

7. Method according to claim 1, wherein the fragmented powder is ground.

8. Method according to claim 1, wherein the powder is compacted to form a green body in a die under a pressure of 300-700 MPa.

9. Method according to claim 8, wherein said pressure is 400-600 MPa.

10. Method according to claim 8, wherein a pressing additive is added to the powder before compaction, at a concentration of between 0.1 and 0.5%.

11. Method according to claim 8, wherein graphite is added to the powder before compaction, at a concentration determined stoichimetrically by the carbon and oxygen content of the powder.

12. Method according to claim 1, wherein the sintering is conducted at a temperature of between 1150° and 1250° C.

13. Method according to claim 12, wherein said temperature is between 1180° and 1220° C.

* * * * *